US008684185B2

(12) United States Patent
Ries

(10) Patent No.: US 8,684,185 B2
(45) Date of Patent: Apr. 1, 2014

(54) SEPARATING DEVICE FOR SEPARATING A MIXTURE OF MAGNETIZABLE AND NON-MAGNETIZABLE PARTICLES PRESENT IN A SUSPENSION WHICH ARE CONDUCTED IN A SEPARATING CHANNEL

(75) Inventor: Günter Ries, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 272 days.

(21) Appl. No.: 13/119,485

(22) PCT Filed: Jul. 17, 2009

(86) PCT No.: PCT/EP2009/059250
§ 371 (c)(1),
(2), (4) Date: Mar. 17, 2011

(87) PCT Pub. No.: WO2010/031613
PCT Pub. Date: Mar. 25, 2010

(65) Prior Publication Data

US 2011/0168607 A1 Jul. 14, 2011

(30) Foreign Application Priority Data

Sep. 18, 2008 (DE) ..... 10 2008 047 852

(51) Int. Cl.
*B03C 1/00* (2006.01)

(52) U.S. Cl.
USPC ..... 209/227; 209/39; 209/225; 209/226; 210/222

(58) Field of Classification Search
USPC ..... 209/39, 213, 223.1, 224, 225–227, 232; 210/222, 223
See application file for complete search history.

(56) References Cited

U.S. PATENT DOCUMENTS 1,425,235 A 8/1922 Bradley
2,678,729 A * 5/1954 Spodig ..... 210/222
(Continued)

FOREIGN PATENT DOCUMENTS

CA 1144485 4/1983 ..... B01D 35/06
DE 244297 A1 4/1987 ..... B03C 1/24
(Continued)

OTHER PUBLICATIONS

Ghebremeskel, A.; "A Continuous, Hybrid Field-Gradient Device for Magnetic Colloid-Based Separations", Journal of Magnetism and Magnetic Materials, 261, pp. 66-72, Apr. 2003.
International PCT Search Report and Written Opinion, PCT/EP2009/059250, 16 pages, Dec. 3, 2009.
Database WPI, Section Ch, Week 198246; London, GB; AN 1982-99445E, (XP002556402), book,=SU899135 A, 1982.

*Primary Examiner* — Joseph C Rodriguez
(74) *Attorney, Agent, or Firm* — King & Spalding L.L.P.

(57) ABSTRACT

A separating device for separating a mixture of magnetizable and non-magnetizable particles present in a suspension conducted in a separating channel, has a ferromagnetic yoke, which is arranged on one side of the separating channel and made of sheet metal and which has at least one magnetic field generator for generating a magnetic deflecting field and a separating element arranged at the exit of the separating channel for separating the magnetic particles, wherein the magnetic field generator provided is a coil arrangement, having coils which can be controlled via a control device in grooves of the yoke along the separating channel such that a deflecting magnetic field, particularly a travelling wave, deflecting substantially toward the yoke; and being variable in terms of time is produced, having substantially field-free regions passing over the entire length of the separating channel.

8 Claims, 7 Drawing Sheets

(56) References Cited

U.S. PATENT DOCUMENTS

| | | | | | |
|---|---|---|---|---|---|
| 3,552,565 | A | * | 1/1971 | Fritz | 209/219 |
| 3,988,240 | A | | 10/1976 | Fraas | 209/214 |
| 4,395,746 | A | * | 7/1983 | Tanaka et al. | 361/143 |
| 4,416,771 | A | * | 11/1983 | Henriques | 209/224 |
| 4,432,873 | A | * | 2/1984 | Schuster | 210/223 |
| 5,224,604 | A | * | 7/1993 | Duczmal et al. | 209/12.2 |
| 5,252,229 | A | * | 10/1993 | Rojey et al. | 210/787 |
| 6,467,630 | B1 | | 10/2002 | Zborowski et al. | 209/459 |
| 6,743,359 | B1 | * | 6/2004 | Smyth et al. | 210/512.1 |
| 2012/0325728 | A1 | * | 12/2012 | Hartmann et al. | 209/223.1 |

FOREIGN PATENT DOCUMENTS

| | | | | |
|---|---|---|---|---|
| DE | 102008047852 | A1 | 4/2010 | B03C 1/00 |
| GB | 2014062 | A | 8/1979 | B03C 1/02 |
| GB | 2333978 | A | 8/1999 | B03C 1/035 |
| JP | 57053258 | A | 3/1982 | B03C 1/23 |
| SU | 899135 | A1 | 1/1982 | B03C 1/10 |

* cited by examiner

SEPARATING DEVICE FOR SEPARATING A MIXTURE OF MAGNETIZABLE AND NON-MAGNETIZABLE PARTICLES PRESENT IN A SUSPENSION WHICH ARE CONDUCTED IN A SEPARATING CHANNEL

CROSS-REFERENCE TO RELATED APPLICATIONS

This application is a U.S. National Stage Application of International Application No. PCT/EP2009/059250 filed Jul. 17, 2009, which designates the United States of America, and claims priority to DE Application No. 10 2008 047 852.0 filed Sep. 18, 2008. The contents of which are hereby incorporated by reference in their entirety.

TECHNICAL FIELD

The invention relates to a separating device for separating a mixture of magnetizable and non-magnetizable particles contained in a suspension conveyed through a separating channel, comprising a laminated ferromagnetic yoke, in particular made of iron, which is arranged on one side of the separating channel and has at least one magnetic field generation means for generating a magnetic deflection field, as well as a separating element arranged at the output of the separating channel in order to separate the magnetic particles.

BACKGROUND

In order to separate such a mixture of magnetizable and non-magnetizable particles, some methods are already known in the prior art and will be presented here in brief. Basically, such methods are based on the magnetic force which acts on the magnetizable particles when there is a magnetic field gradient.

On the one hand batch methods are known, in which magnetizable separating bodies such as iron wires or fibers or iron plates having surface structures such as grooves, studs, etc. in an external magnetic field generate a strong field gradient in their vicinity, which fixes the magnetic particles of a suspension flowing past in a separation phase. In a second phase, the magnetic fraction thus concentrated is suspended in a subsequent flushing step with the magnetic field switched off. Disadvantageously, this method is discontinuous and requires the flushing step.

Continuous methods are effectively known only using disadvantageous mechanically moved parts, in particular even for sizeable magnetizable particles, in which for example a magnet generates a magnetic field gradient on a surface of a rotating hollow cylinder, a disk or a conveyor belt. Owing to this movement, the surface travels out of the magnetic field so that the magnetizable fraction then falls off or is stripped off. An example of this is the separation of iron from scrap. Another disadvantage of these methods is the small permissible distances between the magnet and the separating surface.

It has recently been proposed, by means of a plane or cylindrical magnetic field generation means, to use a gradient field which deflects magnetizable particles to at least one surface of a separating channel, so that magnetizable particles in a suspension flowing parallel to the magnetic field generation means in the separating channel are attracted and describe a path closer to the magnetic field generation means. At the output, separated non-magnetic and magnetic material flows are then intended to flow out through baffles.

This approach, however, has disadvantages in several regards. Specifically, the magnetic field and therefore also the magnetic force are intrinsically greater in the direction of the magnetic field generation means, so that particles far away from the magnetic field generation means are deflected less, while particles close to the magnetic field generation means are magnetically fixed on the surface even against the hydrodynamic forces of the flow. The separating effect is therefore reduced, and on the other hand here again a flushing step must be used for extracting the magnetic fraction after switching off the magnetic field.

SUMMARY

According to various embodiments, a separating device can be provided which allows a continuous and effective separation process for magnetizable and non-magnetizable particles conveyed in a suspension through a separating channel.

According to an embodiment, a separating device for separating a mixture of magnetizable and non-magnetizable particles contained in a suspension conveyed through a separating channel, may comprise a laminated ferromagnetic yoke, in particular made of iron, which is arranged on one side of the separating channel and has at least one magnetic field generation means for generating a magnetic deflection field, as well as a separating element arranged at the output of the separating channel in order to separate the magnetic particles, wherein a coil arrangement is provided as the magnetic field generation means, comprising coils which are arranged in grooves of the yoke along the separating channel, in particular equidistantly, and can be driven by means of a control device so as to form a time-variable deflecting magnetic field, in particular a traveling wave, deflecting essentially toward the yoke and having essentially field-free regions passing over the entire length of the separating channel.

According to a further embodiment, a particular number of coils, in particular 12, of successive coils along the separating channel may be respectively combined to form a period group, the coils of a group respectively being drivable, offset by a fraction of the period duration of an alternating current profile corresponding to the number of coils, with the alternating current profile having at least one currentless time interval. According to a further embodiment, an integer set of period groups can be provided over the length of the separating channel. According to a further embodiment, the alternating current profile respectively may comprise two half-waves with a length of one fourth of the period duration interrupted by two currentless time intervals, each with a length of one fourth of the period duration. According to a further embodiment, the half-wave can be a sinusoidal half-wave and/or a trapezoidal half-wave and/or a triangular half-wave. According to a further embodiment, the control device may comprise an in particular variable-frequency convertor, also designed for phase shifting, having a number of outputs equal to half the number of coils. According to a further embodiment, coils respectively separated by half the number of coils may be electrically connected so that every other coil can respectively be supplied with current in the opposite direction, the coil arrangement being driven via terminals, the number of which corresponds to half the number of coils. According to a further embodiment, a coaxial cylindrical displacer can be arranged in a cylindrical cavity extending through the yoke in order to form the separating channel. According to a further embodiment, a coaxial cylindrical yoke can be arranged in a cylindrical cavity extending through an outer body in order to form the separating channel. According to a further embodiment, a device for generating a tangential circular flow can be provided, in particular obliquely placed inlet nozzles and/or a stirring mechanism and/or obliquely placed baffles, in particular arranged inside the separating channel. According to a further embodiment, the coils can be formed as circumferential annular solenoid coils. According to a further embodiment, the essentially rectangular separating channel can be bounded on one side by the yoke having a plane surface. According to a further embodiment, in the case of a yoke serving as the upper boundary of the separating channel, the separating channel can be configured to be inclined with respect to the vertical in the flow direction, in particular by from 10 to 90 degrees. According to a further embodiment, a protective wall covering the grooves from the separating channel can be provided. According to a further embodiment, the separating element can be a baffle.

BRIEF DESCRIPTION OF THE DRAWINGS

Other advantages and details may be found in the exemplary embodiments described below and with the aid of the figures, in which.

DETAILED DESCRIPTION

Figure 1:
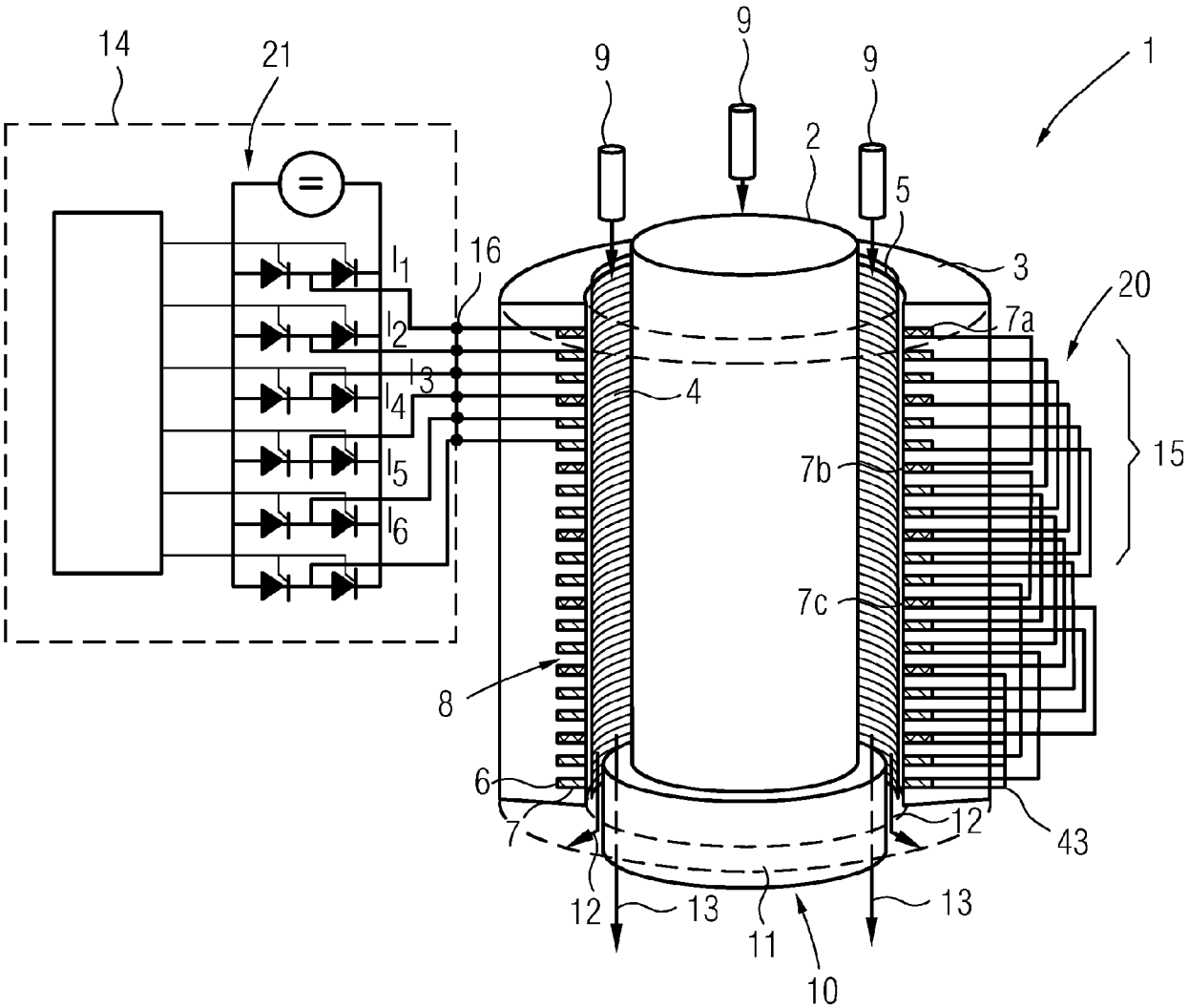
FIG. 1 shows an outline diagram of a first exemplary embodiment of a separating device.

In order to achieve this object, in a separating device of the type mentioned in the introduction, according to various embodiments, a coil arrangement is provided as the magnetic field generation means, comprising coils which are arranged in grooves along the separating channel, in particular equidistantly, and can be driven by means of a control device so as to form a time-variable deflecting magnetic field, in particular a traveling wave, deflecting essentially toward the yoke and having essentially field-free regions passing over the entire length of the separating channel.

In contrast to the prior art, which uses a constant magnetic field or at least (as occurs with alternating current) a constant force distribution in the direction of the magnetic field generation means, so that a flushing step is necessary, the various embodiments now proposes to make the deflecting magnetic field time-variable so as to generate essentially (apart from small contributions from stray fields) field-free regions, in which there is consequently also no force due to a magnetic field gradient. These field gaps travel along the entire separating channel with a predetermined speed, preferably in the same direction as the flow of the suspension to be separated. This has the advantage that a magnetic particle, which adheres to the separating channel's side wall facing the yoke owing to the deflecting magnetic field, briefly experiences no field at a particular time when the essentially field-free region passes through its position, and can be released again from the side wall of the separating channel and transported further by the hydrodynamic forces. The various embodiments thus ensure that buildups of magnetizable particles do not occur on the separating channel's side facing the yoke, since the particles can be released again in the field-free regions. There is however no risk that the magnetizable particles, which have just been released, will drift too far away from the yoke again since the field-free region travels on and the particle soon experiences a deflecting force again in the direction of the yoke owing to the deflecting magnetic field. In continuous operation, it is therefore possible to avoid the disadvantageous flushing step of the prior art and achieve continuous separation of magnetizable and non-magnetizable particles present in the suspension, which is done by the separating element that separates the magnetic fraction transported close to the yoke. This also entails a great time saving since the separating device receives the suspension continuously, and on the other hand it also obviates outlay, for example carrying out a flushing step and the concomitant need to supply a carrier liquid not containing particles, etc.

Such a configuration of the time-varied deflecting magnetic field is achieved by a coil arrangement which comprises coils arranged in grooves along the separating channel, in particular equidistantly. These coils are driven by a control device. In order to generate the corresponding deflecting magnetic field having the essentially field-free regions, they are supplied with current differently as a function of time, in which case in particular the coils for which an essentially field-free region is intended to be generated, may be rendered currentless.

According to an embodiment, a particular number of coils, in particular 12, of successive coils along the separating channel are respectively combined to form a period group, the coils of a group respectively being drivable, offset by a fraction of the period duration of an alternating current profile corresponding to the number of coils, with the alternating current profile having at least one currentless time interval. In this case, it has proven particularly advantageous for the interconnection that an integer set of period groups is provided over the length of the separating channel. For driving the coils, an alternating current profile which has at least one currentless time interval is accordingly provided, in particular stored inside the control device. This alternating current profile having the currentless time interval has a particular period duration.

After this, it is repeated. The control device now drives the coils of the coil arrangement so that they respectively operate offset by a fraction of the period duration of the alternating current profile corresponding to the number of coils, which means for a number of coils equal to 12 for example, each successive coil is driven offset by $1/12$ of the period duration. Between two coils supplied with current in the same way, there are therefore always 11 offset-driven coils in this exemplary case.

In an expedient further configuration, the current profile may respectively comprise two half-waves with a length of one fourth of the period duration interrupted by two currentless time intervals, each with a length of one fourth of the period duration. Such an alternating current profile is easy to generate; the half-wave may be a sinusoidal half-wave or a trapezoidal half-wave or a triangular half-wave. There is therefore not a conventional alternating current drive; rather, there are respectively currentless time intervals when the current would in any case reach a value of 0, which have the same length as the corresponding half-waves. A traveling wave with gaps is formed in this way, in which case with the use of 12 coils in a period group, two times three successive coils are always currentless at each particular time. In addition to the essential effect according to various embodiments, that during passage of the traveling wave the separated particles can be released again in the essentially field-free region and transported some way further by the hydrodynamic forces of the suspension flow, there is the reinforcing factor in this configuration that on both sides of the deflection field maxima determined by the maximum of the half-wave there are field gradients virtually parallel to the separating channel wall, where the particles experience a force against or in the direction of the separating element. The latter reinforce the transport of the magnetic fraction along the wall of the separating channel in the direction of the output, without remixing with the volume of the suspension. The direction of the deflecting magnetic field at a position also rotates during passage of the traveling wave. A torque is therefore exerted on the magnetic particles, so that the magnetic particles also rotate. This facilitates re-release of the separated particles in the essentially field-free region and counteracts fixing and agglomeration to form larger particles.

For the simplest possible driving of the coil arrangement by the control device when using an alternating current profile, the control device may comprise an in particular variable-frequency convertor, also designed for phase shifting, having a number of outputs equal to half the number of coils. Suitable convertors are known; with 12 coils per period group, for example, a variable-frequency convertor having 6 outputs may be used. This may, for example, consist of two conventional 3-phase convertors with correspondingly adapted driving of the inverter bridges.

According to a further embodiment, coils respectively separated by half the number of coils may be electrically connected so that every other of the coils connected together can respectively be supplied with current in the opposite direction, the coil arrangement being driven via terminals, the number of which corresponds to half the number of coils. Thus, the same current flows through equivalently positioned coils of successive period groups. Like the pattern of the deflection field, the current pattern is also repeated after each half period length, but with the opposite current direction. With for example 12 coils per periodicity group, to this end every sixth coil is electrically connected in series, the current direction respectively being reversed. In this way, six individually driven coil groups are formed. A current distribution known from the winding technology of three-phase motors and generators is therefore achieved along the coil stack, which generates the desired traveling field. The outputs of the last 6 coils are all electrically connected at a "star point". In three-phase technology, this circuit is known as a star circuit, although the known triangular circuit is also possible.

For the general geometrical configuration of the separating device, the various embodiments essentially provide two embodiments, namely a cylindrical embodiment and a plane embodiment. According to a first embodiment of the separating device, a coaxial cylindrical displacer is arranged in a cylindrical cavity extending through the yoke in order to form the separating channel. As an alternative to this, of course, a coaxial cylindrical yoke may also be arranged in a cylindrical cavity extending through an outer body in order to form the separating channel. Configurations in which the yoke internally or externally bounds the separating channel, which is annular in cross section, may also be envisaged. An embodiment having an internally arranged yoke proves to be particularly advantageous, however, when a device for generating a tangential circular flow is provided, in particular obliquely placed inlet nozzles and/or a stirring mechanism and/or obliquely placed baffles, in particular arranged inside the separating channel. A circular flow is then generated, so that the centrifugal forces move the non-magnetic particles to the outer wall of the outer body, while the internally acting force of the deflecting magnetic field predominates on the magnetizable particles. Better separation and a better purity of the end products are achieved in this way. In general, with a cylindrical embodiment, it is expedient for the coils to be formed as circumferential annular solenoid coils.

In a second, plane embodiment of the separating device, the essentially rectangular separating channel may be bounded on one side by the yoke having a plane surface. It should, however, be pointed out here that in principle all geometrically appropriate configurations and shapes may be used for the separating channel and the yoke. In a configuration having a rectangular separating channel and the yoke adjoining on one side, so-called racetrack coils may be used in particular; in this case, in contrast to the cylindrical embodiment, the turns do not extend completely along the separating channel but rather in winding heads along the opposite side of the yoke from the separating channel. According to a further embodiment, in the case of a yoke serving as the upper boundary of the separating channel, the separating channel may then be configured to be inclined with respect to the vertical in the flow direction, in particular by from 10° to 90°. By the oblique setting with the upwardly facing magnet system, the force of gravity is advantageously used to improve the separation effect. This is because the non-magnetizable particles sink owing to the force of gravity onto the lower side of the separating channel, while the magnetizable particles are drawn upward by the deflecting magnetic field.

In general, it is expedient to provide a protective wall covering the grooves from the separating channel, so that the suspension does not enter the grooves and the coils. The protective wall, which may be connected to other walls forming the separating channel, therefore forms the separating surface directed toward the yoke, in the direction of which the deflecting force acts.

As the separating element, it is possible to use a baffle which separates the flow of magnetizable particles conveyed on the side facing the yoke from that of the non-magnetizable particles.

The specific size and configuration of the separating device is effectively dictated by the parameters which are intended to determine its performance, i.e. primarily by the throughput which is intended to be achieved. In general, however, it may be noted that the separating channel width should be less than or similar to the range of the deflecting magnetic field, for example with the deflecting magnetic field dropping off exponentially in the case of a traveling wave so that the separating channel width should be less than or similar to the decay length.

FIG. 1 shows a first exemplary embodiment of a separating device 1. It comprises a cylindrical displacer 2, which is surrounded at a distance by a coaxial cylindrical laminated yoke 3 made of iron. Between the displacer 2 and the yoke 3, a separating channel 4 is thus formed which is separated by a protective wall 5 from the iron yoke 3 bounding it outward.

The iron yoke 3 furthermore has circumferential grooves 6 facing the separating channel 4, in which equidistantly spaced solenoid coils 7 of a coil arrangement 8 are arranged, the turns of which are circumferential, i.e. they enclose the separating channel 4.

A suspension, having for example magnetizable and non-magnetizable particles introduced into water as a carrier liquid, is introduced continuously into the separating channel 4, for example through application means indicated here merely by 9. The purpose of the separating device 1 is to split it into a magnetic fraction and a non-magnetic fraction with continuous flow of the suspension through the separating channel 4, which is done at the end of the separating channel 4 by a separating element 10, in this case a baffle 11, the arrows 12 indicating the magnetic fraction and the arrows 13 the non-magnetic fraction.

Continuous operation of the separating device 1 is made possible by a particular supply of current to the coil arrangement 8, for which a control device 14 is used. By corresponding supply of current to the individual coils 7, a traveling wave is generated in the separating channel 4, as will be explained in more detail below, which comprises gaps i.e. field-free regions, that pass over the entire length of the separating channel 4.

Figure 2:
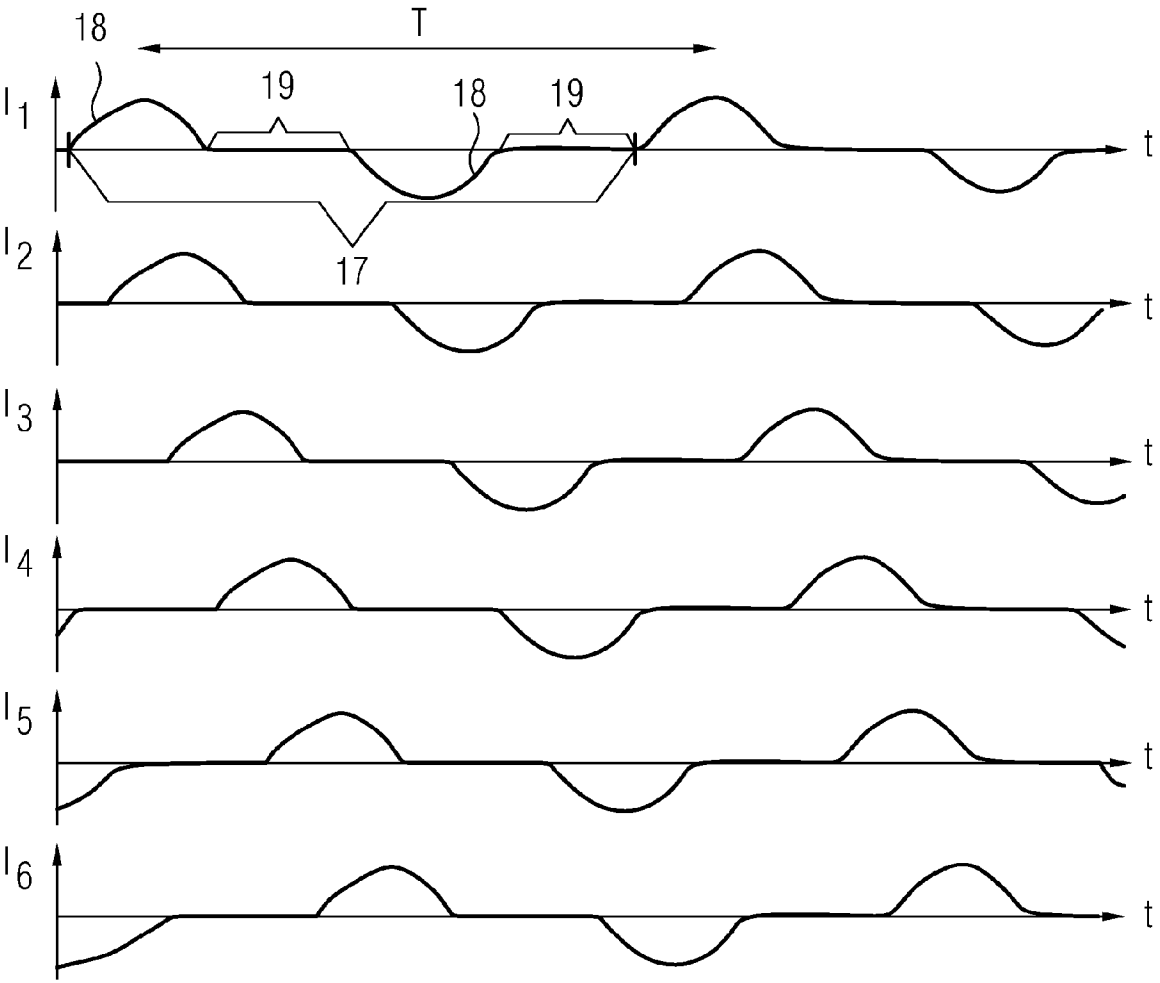
FIG. 2 shows graphs showing the current profile and the offset driving.

To this end, in this case 36 coils 7, not all of which are represented for the sake of clarity, are divided into three period groups having a coil number of 12 coils each, one period group 15 being denoted in the drawing. In order to drive the 36 coils 7 of the coil arrangement 8 by the control device 14, merely six terminals 16 are necessary, as will be explained below, which means that six input signals $I_1$ to $I_6$ are generated, which will now be explained in more detail with additional reference to FIG. 2.

The basis of the driving by the control device 14 is a current profile 17 having a period duration of T, which comprises two sinusoidal half-waves 18 each with a duration of T/4, which are respectively separated by a currentless time interval 19 likewise with a duration of T/4. The coils 7 of a period group are now intended to be driven respectively offset by T/12 with the current profile 17, so as to produce a traveling wave having gaps i.e. essentially field-free regions. In this regard, FIG. 2 firstly represents the six drive currents $I_1$ to $I_6$ as a function of time. It can be seen that the current $I_2$ is shifted by T/12 relative to $I_1$, etc., so as to provide the traveling wave. These currents $I_1$ to $I_6$ are now delivered via the terminals 16 respectively to the first six coils 7, the other coils 7 of the coil arrangement 8 being driven via corresponding connections, indicated at 20, as will be described below. Every sixth coil is connected, i.e. the first coil to the seventh coil, the seventh coil to the thirteenth coil, etc. Every other coil of the coils connected in this way is supplied oppositely with current. For example, if the coil 7*a* receives the current signal $I_1$, then the seventh coil 7*b* connected to it receives the current signal $-I_1$, and the thirteenth coil (already in the next period group 15) 7*c* again the signal $I_1$, etc. In this way, with only six input signals, it is possible to drive all three coil groups 15 correctly in order to generate a traveling wave. The outputs of the last 6 coils are all electrically connected together at a star point 43.

In order to generate the current signals $I_1$ to $I_6$, the control device 14 comprises a frequency-dependent converter 21 which contains two conventional three-phase converters. At this point, it should again be emphasized clearly that said coil number of twelve and period group number of three are merely exemplary values, and that the underlying concept can also be readily adapted to other configurations.

Figure 3:
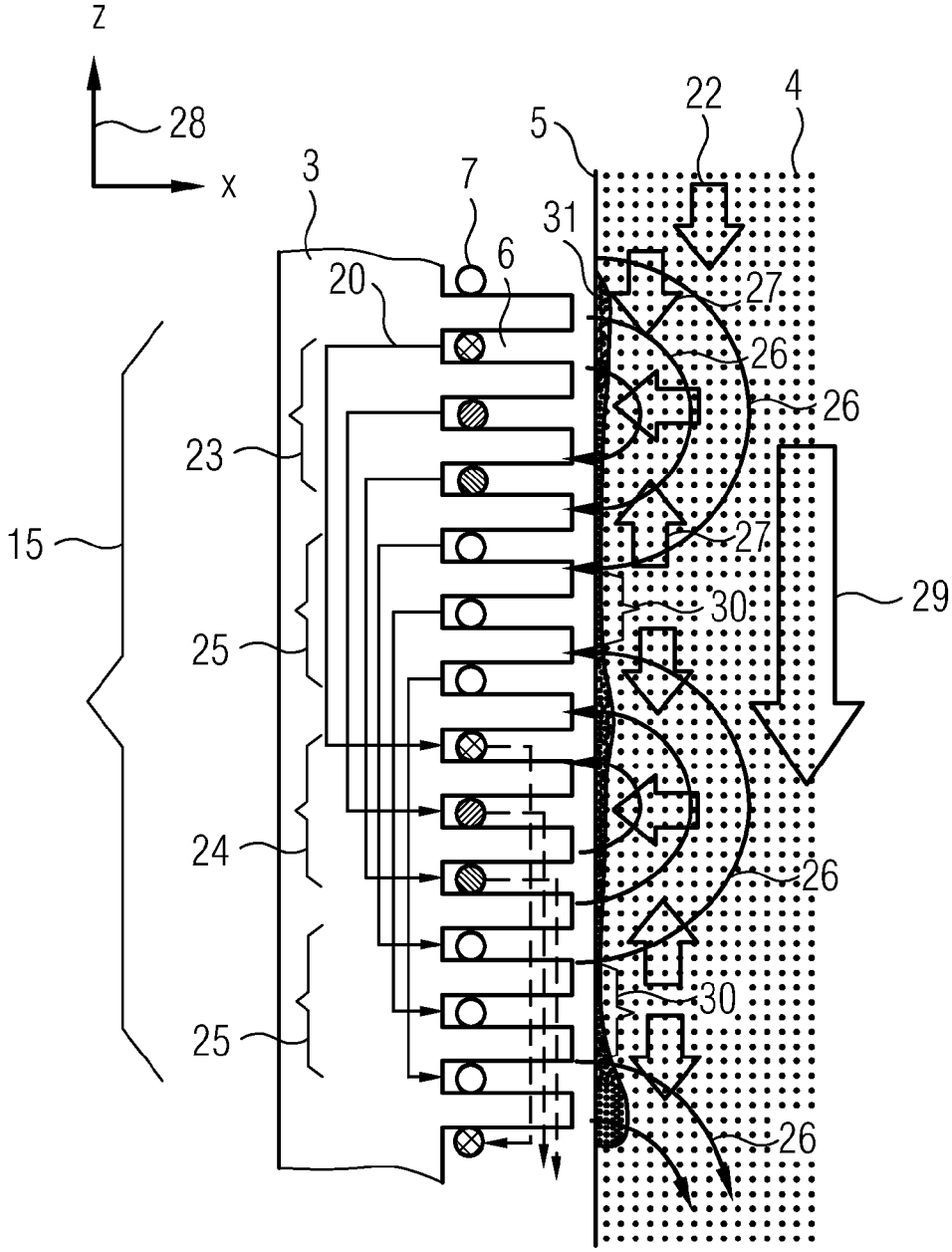
FIG. 3 shows a diagram to illustrate the traveling field and the force directions.

FIG. 3 now shows the result of this driving and interconnection of the coils with the aid of an enlarged highlighted period group 15. It shows the iron yoke 3 with the coils 7 arranged in the grooves 6 as well as the connections 20 within the coil group 15, the protective wall 5 as well as the separating channel 4 through which the suspension flows according to the arrow 22. According to the corresponding driving, cf. FIG. 2, three coils 7 of a coil group 15 are respectively represented as a group 23 through which current flows, a further group 24 of coils 7 is correspondingly supplied with current oppositely, and two further groups 25, arranged between groups 23 and 24 supplied with current, are represented as currentless in the instantaneous picture represented in FIG. 3. This driving of the coils 7 relates to a particular deflecting magnetic field, which is indicated here by the magnetic equipotential lines 26 shown in the separating channel. The arrows 27 indicate force components in the longitudinal direction (z direction) and radial direction (x direction, cf. coordinate system 28). The arrow 29 indicates the direction in which the generated deflecting magnetic field travels. As can be seen, the currentless time intervals form essentially field-free regions 30 which likewise travel with it, i.e. pass over the length of the separating channel 4. Lastly, FIG. 3 also indicates at 31 the magnetizable particles, attracted to the protective wall 5.

Figure 4:
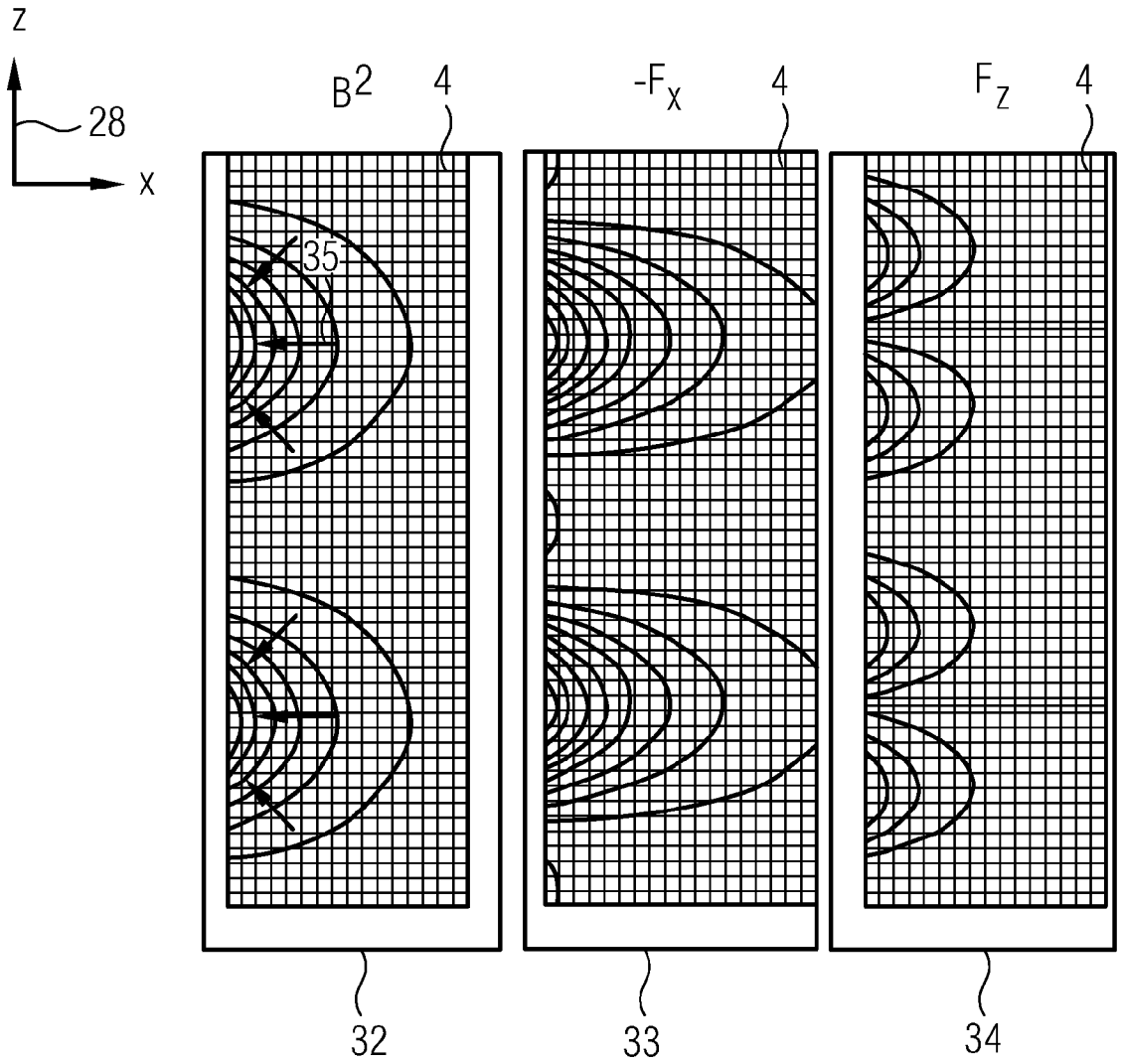
FIG. 4 shows graphs of the profile of the field and the force components.

In the form of graphs 32, 33 and 34, FIG. 4 now shows the resulting field and force distribution in more detail. Graph represents the equipotential lines of the square of the magnitude $B^2$ of the deflecting magnetic field, graph 33 shows the equipotential lines of the negative force component in the x direction (coordinate system 28), i.e. the force $-F_x$ in the direction of the yoke 3, and graph 34 shows the equipotential lines of the magnitude corresponding to the force component $F_z$ in the z direction. The resulting forces and force directions are indicated by the arrows 35 in graph 32.

For the continuous separation process, the field and force conditions represented in FIGS. 3 and 4, which travel as a function of time as explained, have the following importance. Owing to the force component in the x direction, magnetizable particles are deflected toward the yoke 3 and may accumulate there. Since the deflecting magnetic field falls off exponentially in the direction of the displacer 2, as explained, the strong attractive forces close to the protective wall 5 can periodically be stronger than the hydrodynamic force of the flow, so that the magnetizable particles 31 are initially not transported further. Here, the essentially field-free regions 30 provided according to various embodiments now intervene, which owing to their own movement soon reach such a magnetizable particle so that the deflecting force temporarily vanishes, and the particle can be released and transported some way further by the hydrodynamic flow, before it is again held close to the protective wall 5 by the x component of the deflecting force of the next half-wave 18. In this way, build-ups which would have to be removed elaborately in a subsequent flushing step are not formed on the protective wall 5. Moreover, the configuration with such a traveling wave comprising such currentless time intervals 19 also has other advantages by virtue of the z components of the deflecting force. On both sides of the field maxima, as can be seen, there are gradients virtually parallel to the wall where the magnetizable particles experience a force against or in the direction of the end of the separating channel 4. The latter reinforce the transport of the magnetic fraction along the protective wall 5 in the direction of the output, without remixing with the volume of the suspension. Considered as a function of time, the direction of the magnetic field at a particular position also rotates during passage of the traveling wave. A torque is therefore exerted on the magnetizable particles, so that they are set in rotation, which facilitates re-release of the separated material in the essentially field-free region, i.e. the field gap, and counteracts fixing and agglomeration to form larger particles.

The pattern shown in FIGS. 3 and 4 progresses periodically along the entire separating channel. A spatially and temporally periodic traveling wave is therefore set up in the cylindrical working space. With a period duration T and a spatial repeat or pole length L, the traveling wave consequently propagates with a speed v=L/T. The range of the deflecting magnetic field and therefore of the magnetic force is given by $x_0=L/2\pi$. The width of the separating channel 4 should be selected to be less than or similar to $x_0$.

The other parameters for a specific configuration of the separating device 1 need to be determined with the aid of the desired operating values. By way of example, it will be indicated here that with a suspension volume flow rate of 200 $m^3$ per hour and a flow velocity of 0.333 m per second, the separating channel may for example have a length of 1 m. With a protective wall diameter of 1.6 m, a separating channel width of 3 cm is provided. 12 coils are respectively combined to form a period group, three period groups in particular being provided, i.e. 36 grooves. The period length may in this case be 0.333 m, and the groove size 14×60 $mm^2$. The frequency of the traveling wave in this exemplary embodiment is then 1 Hz.

Other characteristic values of this specific exemplary embodiment are the copper current density of 5 $A/mm^2$ for a copper proportion of 75% and a current of 3000 A in the groove. Such a separating device would then require an electrical power of 30 kW.

Figure 5:
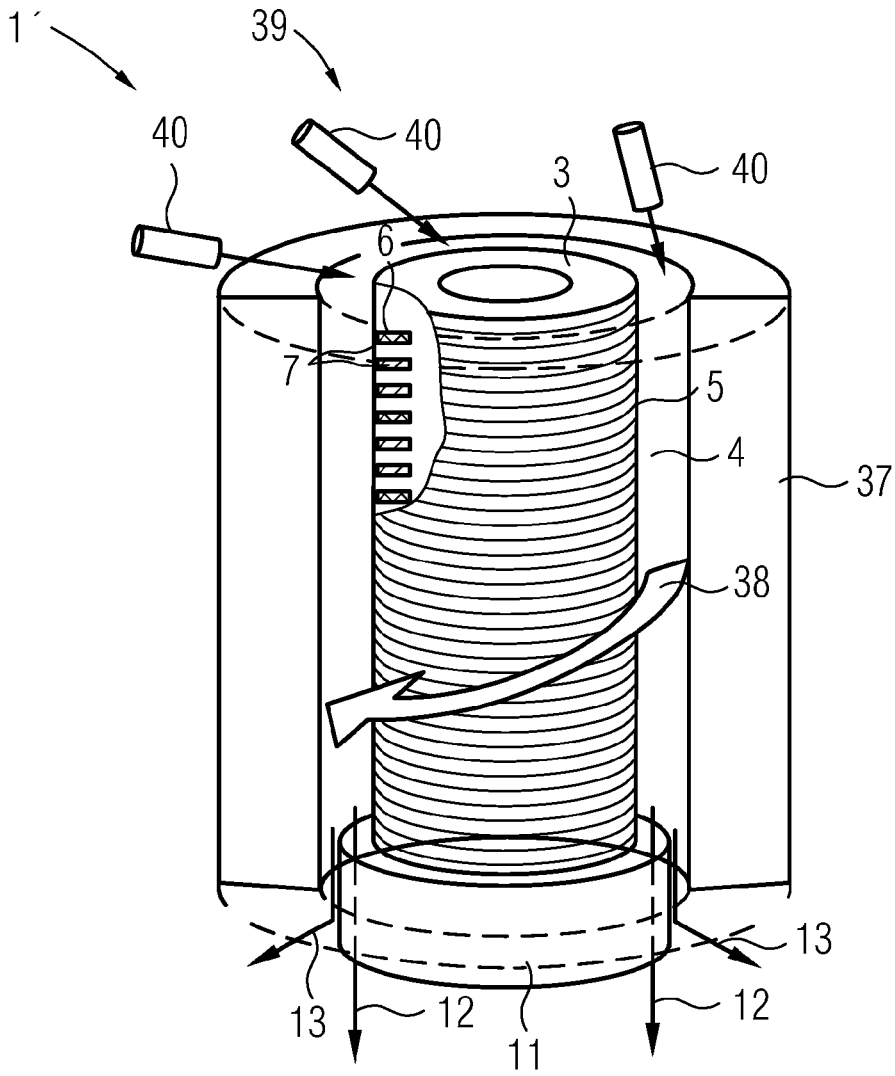
FIG. 5 shows an outline diagram of a second exemplary embodiment of the separating device.

FIG. 5 is an outline diagram of a second exemplary embodiment of a separating device 1', components which are the same being provided with the same references here and in what follows for the sake of better clarity. The laminated yoke 3 made of iron, with the coils 7 partially represented below the protective wall 5 in the grooves 6, is in this case arranged internally but still formed cylindrically, and is surrounded by a coaxial cylindrical outer body 37 in order to form the separating channel 4. The functionality in terms of the traveling wave generated and the field-free regions is the same, so that reference is made to the first exemplary embodiment for the discussion in this regard. The magnetic fraction is now captured internally in relation to the baffle, arrow 12, and the non-magnetic component externally, arrow 13. In order to improve the separation effect, in this exemplary embodiment a circular flow indicated by the arrow 38 is imparted to the suspension. To this end, the use of obliquely placed inlet nozzles 40 is provided as a device 39 to generate the tangential circular flow. Owing to the resulting centrifugal forces, non-magnetizable particles are moved outward toward the outer body 37, while the magnetic force resulting from the deflection field predominates for the magnetizable particles and they accumulate internally. The separation effect is thus improved.

Figure 6:
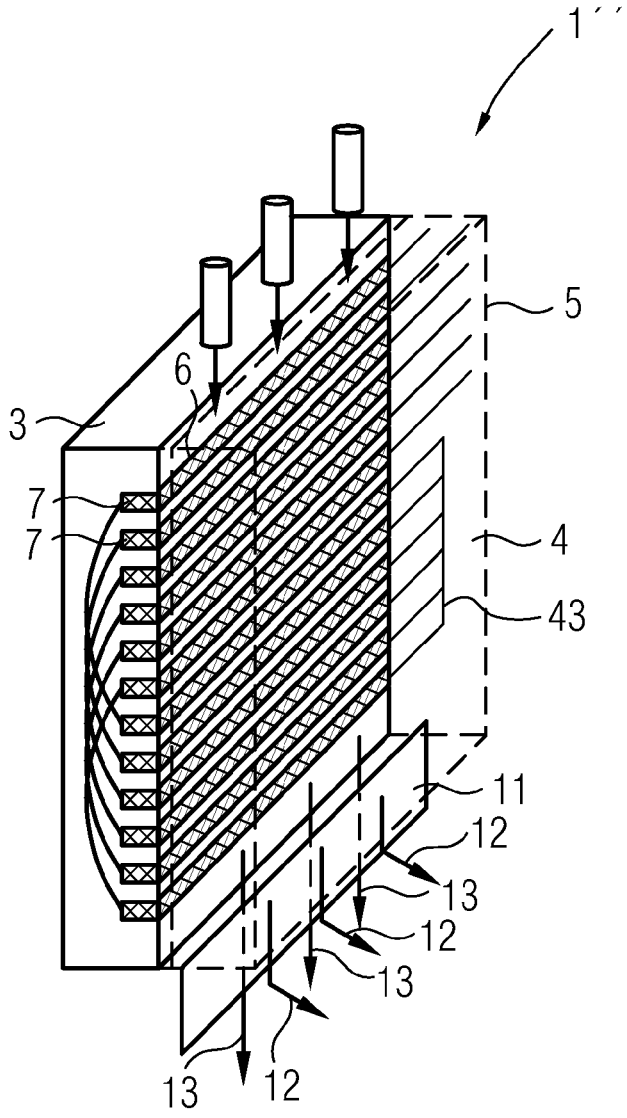
FIG. 6 shows an outline diagram of a third exemplary embodiment of the separating device.

FIG. 6 shows a third exemplary embodiment of a separating device 1", in which a rectangular separating channel 4 is now provided, which is delimited on one side behind a protective wall 5 from the likewise rectangular yoke 3, which again comprises equidistant grooves with coils 7 arranged therein. The coil conductors of the coils 7 extend along the grooves, overall racetrack coils may be used, although usually the coil conductors are continued via a winding head or through the interior of the iron yoke 3 after leaving a groove, so that they pass in the opposite direction through the groove 6 offset by half the number of coils, etc. The corresponding periodicity is thereby automatically achieved. The coils are closed by a feedback into the first groove 6. The principle of the field generation and the traveling wave, however, remains basically the same as in the first exemplary embodiment.

The transport of the magnetic and non-magnetic fractions behind the baffle 11 is again represented by the arrows 12 and 13.

Figure 7:
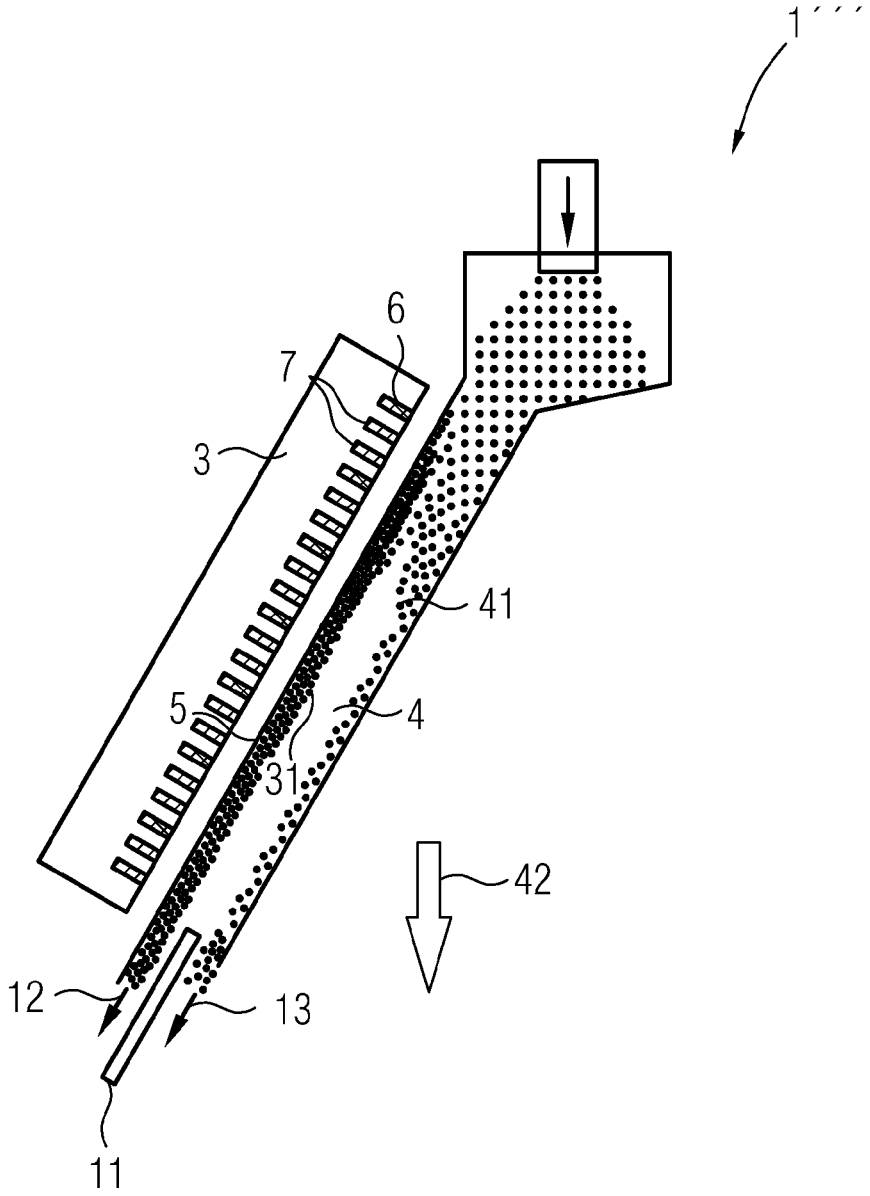
FIG. 7 shows an outline diagram of a fourth exemplary embodiment of the separating device.

FIG. 7 lastly shows a fourth exemplary embodiment of a separating device 1'", which essentially corresponds to that of FIG. 6 although it differs from the separating device 1" by an oblique placement of the separating channel by an angle of 30° with respect to the vertical. The effect of this oblique placement is that the force of gravity acts on the non-magnetizable particles 41 and removes them from the yoke 3 arranged above, while the magnetizable particles 31 accumulate on the protective wall 5 facing the yoke 3 owing to the stronger magnetic deflection force. The effect of the force of gravity is indicated by the arrow 42. A better separation effect is thereby again achieved.

The discharge of the respective fractions is again represented by the arrows 12 and 13 at the baffle 11.

What is claimed is:

1. A separating device for separating a mixture of magnetizable and non-magnetizable particles contained in a suspension conveyed through a separating channel, comprising:

a ferromagnetic yoke which is arranged on one side of the separating channel and has at least one magnetic field generator for generating a magnetic deflection field, a separating element arranged at the output of the separating channel in order to separate the magnetizable and non-magnetizable particles, wherein the at least one magnetic field generator comprises a coil arrangement comprising coils which are arranged in grooves of the ferromagnetic yoke along the separating channel and driven by a control device with an alternating current to form a time-variable deflecting magnetic field deflecting essentially toward the ferromagnetic yoke and having essentially field-free regions passing over an entire length of the separating channel;

a device for generating a tangential circular flow including a plurality of obliquely placed inlet nozzles, a stirring mechanism, and obliquely placed baffles inside the separating chamber.

2. The separating device according to claim 1, wherein a coaxial cylindrical displacer is arranged in a cylindrical cavity extending through the yoke in order to form the separating channel.

3. The separating device according to claim 1, wherein a coaxial cylindrical yoke is arranged in a cylindrical cavity extending through an outer body in order to form the separating channel.

4. The separating device according to claim 2, wherein the coils are formed as circumferential annular solenoid coils.

5. The separating device according to claim 1, wherein a protective wall covering the grooves from the separating channel is provided.

6. The separating device according to claim 1, wherein the separating element is a baffle.

7. The separating device according to claim 1, wherein the coils are arranged equidistantly in grooves of the yoke along the separating channel.

8. The separating device according to claim 1, wherein the laminated ferromagnetic yoke is made of iron.

* * * * *